US008506101B2

(12) United States Patent
Mathers et al.

(10) Patent No.: US 8,506,101 B2
(45) Date of Patent: Aug. 13, 2013

(54) BACK-ILLUMINATED SWITCH PANEL

(75) Inventors: Stephen John Mathers, Glasgow (GB); Michael Thaniotis, Glasgow (GB)

(73) Assignee: John McGavigan Limited (GB)

( * ) Notice: Subject to any disclaimer, the term of this patent is extended or adjusted under 35 U.S.C. 154(b) by 836 days.

(21) Appl. No.: 11/666,768

(22) PCT Filed: Nov. 2, 2005

(86) PCT No.: PCT/GB2005/004213

§ 371 (c)(1),
(2), (4) Date: Mar. 27, 2009

(87) PCT Pub. No.: WO2006/048627

PCT Pub. Date: May 11, 2006

(65) Prior Publication Data

US 2012/0039020 A1 Feb. 16, 2012

(30) Foreign Application Priority Data

Nov. 2, 2004 (GB) ..... 0424245.9

(51) Int. Cl.
*G09F 13/00* (2006.01)

(52) U.S. Cl.
USPC ..... 362/23.04; 362/23.12; 362/85; 362/489; 200/311; 200/312

(58) Field of Classification Search
USPC ..... 362/85, 471, 489, 488, 28, 29, 30, 362/23.11, 23.12, 23.13; 200/311, 312
See application file for complete search history.

(56) References Cited

U.S. PATENT DOCUMENTS

| | | | | |
|---|---|---|---|---|
| 4,017,848 | A | 4/1977 | Tannas, Jr. | |
| 4,320,268 | A | 3/1982 | Brown | |
| 4,321,441 | A | 3/1982 | Thornburg | |
| 5,103,085 | A * | 4/1992 | Zimmerman | 250/221 |
| 5,239,152 | A | 8/1993 | Caldwell et al. | |
| 5,698,826 | A | 12/1997 | Cracraft et al. | |
| 5,934,450 | A | 8/1999 | Rynk et al. | |
| 5,987,793 | A * | 11/1999 | Ebine | 40/580 |
| 6,158,156 | A * | 12/2000 | Patrick | 40/443 |
| 7,396,147 | B2 * | 7/2008 | Munro | 362/351 |
| 2004/0021961 | A1 * | 2/2004 | Munro | 359/843 |
| 2004/0247363 | A1 * | 12/2004 | Kaufman et al. | 400/472 |
| 2005/0115327 | A1 * | 6/2005 | Kroll et al. | 73/730 |

FOREIGN PATENT DOCUMENTS

| | | | |
|---|---|---|---|
| DE | 199 10 240 | A1 | 9/2000 |
| DE | 10307473 | A1 | 9/2004 |
| EP | 0 470 403 | A2 | 2/1992 |
| EP | 1344688 | A2 | 9/2003 |

(Continued)

OTHER PUBLICATIONS

Search Report corresponding to GB 0023841.0 dated Dec. 7, 2000.

(Continued)

*Primary Examiner* — Ismael Negron
(74) *Attorney, Agent, or Firm* — Myers Bigel Sibley & Sajovec, P.A.

(57) ABSTRACT

A switch panel having a panel member and at least one switch member, wherein the panel member has a first appearance when front lit, and at least one second appearance when at least a portion thereof is back lit by illumination means controlled by the at least one switch member. The at least one switch member is provided on a reverse side of the panel member and is controlled by a user from an obverse side of the panel member.

57 Claims, 11 Drawing Sheets

(56) References Cited

FOREIGN PATENT DOCUMENTS

| | | | |
|---|---|---|---|
| EP | 1344688 | A3 | 11/2004 |
| GB | 2027551 | A | 2/1980 |
| GB | 2354738 | A | 4/2001 |
| GB | 2408246 | A | 5/2005 |
| GB | 2412806 | A | 10/2005 |
| WO | WO 00/17900 | A1 | 3/2000 |
| WO | WO 2004/015731 | A1 | 2/2004 |

OTHER PUBLICATIONS

Search Report corresponding to GB 0522333.4 dated Feb. 20, 2006.
International Search Report corresponding to GB 2005/004213 mailed Mar. 8, 2006.
Examination Report corresponding to GB 05807307.3 dated Jul. 2, 2009.
International Search Report corresponding to Great Britain Application No. PCT/GB05/004213 mailed Mar. 8, 2006.

* cited by examiner

BACK-ILLUMINATED SWITCH PANEL

CROSS-REFERENCE TO RELATED APPLICATIONS

This application is a 35 U.S.C. §371 national phase application of PCT Application No. PCT/GB2005/004213, filed on Nov. 2, 2005, which claims priority from Great Britain Application Serial No. 0424245.9 filed on Nov. 2, 2004, the disclosures and contents of which are incorporated by reference herein in their entireties. The above-referenced PCT International Application was published in the English language as International Publication No. WO 2006/048627 A1.

FIELD OF INVENTION

The present invention relates to a switch panel or control panel, which may, for example, be a control panel, touch screen, keypad or user/man machine interface. The invention further relates to an apparatus including such a switch panel, for example an automotive vehicle, or electronic/electrical apparatus such as white goods, consumer electronic goods or industrial electronic apparatus, or a keyless entry system, for example, for glass doors or a window, for example, a shop window.

BACKGROUND TO INVENTION

Modern electronic products, particularly those in automotive vehicles such as cars/automobiles, and white goods such as washing machines, microwave ovens, and the like, are provided with an increasing number of electronic controls and equipment. A problem has therefore arisen in that a user, e.g. driver or passenger, can easily become confused when presented with an array of control switches and knobs. This problem also applies to other electronic equipment and apparatus.

It is an object of at least one embodiment of at least one aspect of the present invention to obviate or at least mitigate one or more problems in the prior art.

It is a further object of at least one embodiment of at least one aspect of the present invention to selectably reduce the amount of switch/control information presented or available to a user, e.g. driver or passenger.

It is a yet further object of at least one embodiment of at least one aspect of the present invention to provide a switch panel that is aesthetically/cosmetically, more appealing and/or functionally less confusing than the prior art.

It is a still yet further object of at least one embodiment of at least one aspect of the present invention to improve the security of apparatus, such as an automotive vehicle, by hiding or obscuring from view switches of the switch panel except when in legitimate use. In this way a car thief cannot easily establish what equipment is installed in the vehicle.

It is also an object of at least one embodiment of the at least one aspect of the present invention to reduce the likelihood of potential failure due to fluid or particulate ingress.

SUMMARY OF INVENTION

One or more of the aforementioned problems may be addressed by the general solution of providing a switch panel or control panel, such as an electrical or electronic switch panel or control panel, having a panel member and at least one switch member or means or control member or means, wherein the panel member has a first appearance when front lit, and at least one second appearance when at least a portion thereof is back lit.

The back lighting may be provided by illumination means controlled by the at least one switch member or means.

The at least one switch member or means may be provided on a reverse (rear) side of the panel member and may be controlled by a user from an obverse (front) side of the panel member.

The or each at least one switch member or means or control member or means may be an electrical or electronic switch.

According to a first aspect of the present invention there is provided a switch panel or control panel having a panel and switch means, the panel having an obverse side and a reverse side, wherein, in use, when viewed from the obverse side the panel has a first appearance when not illuminated from the reverse side, and at least one second appearance when illuminated from the reverse side.

The switch means may comprise at least one switch, and preferably may comprise a plurality of switches. The switch means may at least partly comprise an at least partially transparent conductor, e.g. indium tin oxide (ITO), or a non-transparent conductor, e.g. silver or copper, which may be printed.

The panel may comprise at least one marking or indicia, and preferably may comprise a plurality of markings or indicia, each marking being associated with one of the plurality of switches.

Preferably at least one of the at least one markings is visibly illuminated in at least one of the at least one second appearances.

Preferably in the first appearance the at least one marking is not illuminated and is either not visible or only partially visible, e.g. in outline.

The switch panel may comprise at least one illumination means, and preferably may comprise a plurality of illumination means, each illumination means preferably being associated with one of the plurality of switches. Each illumination means may, for example, comprise an LED and optionally a diffuser means.

Preferably when a particular switch is off, the associated illumination means is off. Thus the associated marking is not back illuminated, and for example, when front lit, e.g. in daylight, the associated marking is not visible or alternatively only partially visible, e.g. in outline.

Preferably when a particular switch is on the associated illumination means is on. Thus the associated marking is back illuminated, and for example either in daylight or at night the associated marking is visible.

Preferably the switch or switches are mounted on a rear side of the panel, advantageously substantially coplanarly one with the other and substantially parallel to the panel.

Preferably the illumination means are mounted on a reverse side of the switch or switches.

Preferably the panel may comprise a substantially rigid sheet. Advantageously, the rigid sheet may comprise plastics material, e.g. polycarbonate, acrylic or polyester. Alternatively, the rigid sheet may be glass. The sheet may have a plurality of ink layers printed thereon so as to provide the required visual effects, e.g. preferably on the rear surface thereof, or alternatively on the obverse surface thereof. The sheet may be around 0.5 mm to 10 mm in thickness, e.g. 1 mm to 2 mm.

Alternatively the panel may comprise an applique or foil or flexible membrane, e.g. made of a plastic material, e.g. polycarbonate, acrylic or polyester. The foil may have a plurality of ink layers printed thereon so as to provide the required visual effects. The foil may be around 50 to 500 μm in thickness, e.g. 50 to 250 μm. The foil may be moulded, e.g. in-moulded, to a rigid (transparent) backing sheet of plastic or polymer material, e.g. polycarbonate, acrylic or polyester.

Each switch may be switched on or off by a user by placing a finger on or adjacent the associated marking thereby selectably switching the associated illumination means on or off. In this way various functions of the switch panel can be controlled.

The panel may provide one or more switch portions which may be concave or convex, to provide a visual and/or tactile indication of a position of a switch, particularly in a passive (e.g. non-illuminated) mode.

Additionally and/or alternatively, the switch portions may be provided with a soft touch coating, which may be applied to the obverse surface of the panel, and which may provide a tactile indication of a position of a switch.

The switch portion (s) may be depressible so as to provide motive and/or audible feedback, in use.

The switch panel may be adapted for use as a part of an automotive vehicle, e.g. as a centre stack panel, or alternatively, as at least part of a door panel or roof panel or other panel for use within (inside) an automotive vehicle.

In such use the switch panel may provide markings/switches for one or more of: ventilation controls, air conditioning, climate control, electronic/entertainment equipment, e.g. audio equipment, CD, DVD, MP3, telephone, television, radio, navigational equipment and associated switches which associated switches, e.g. volume etc, may be illuminated only when the respective equipment control is selected.

The switch panel may alternatively be adapted for use in electronic goods, e.g. white goods, consumer electronic goods, or industrial equipment.

The switch panel may alternatively be adapted for use in, or form a part of, a glass door or window, e.g. for use in a keyless entry system.

The switch panel may alternatively be adapted for use in other modes of transportation, e.g. motorcycles, trains, planes or boats.

The switch or switches may be selected from a type preferably comprising capacitive. Alternatively and advantageously the switch or switches may be selected from a type comprising infrared. Alternatively the switch or switches may be selected from a type comprising piezoelectric, or alternatively, mechanical. Alternative types of switches may be apparent to the skilled person.

In the case of capacitive, infrared or piezoelectric, the/each switch may be provided with tactile feedback means. For example, a user when placing a finger over a selected switch may feel a localised vibration or oscillation so as to sense that the selected switch has been turned on or off. Such tactile feedback may be provided by, e.g. a piezoelectric transducer, each switch preferably being provided with an associated piezoelectric transducer.

The panel may be a decorative panel. The panel may comprise a plurality of layers, said layers including a first layer which is an at least partially transparent layer, and a second layer, at least selected areas of said second layer having a degree of contrast in opacity and/or colour, said first and second layers being associated with a substrate layer having an obverse surface and a reverse surface, wherein means are provided for furnishing said substrate layer with a partially transparent tinted appearance, wherein said first layer comprises a coating comprising a transparent carrier in which are supported non-opaque particulate light-splitting or light-frequency modifying materials, said materials being capable of causing light-splitting effects when viewed in light falling in the direction of the obverse surface of said substrate layer, and wherein said second layer provides said at least selected areas rearwardly of said first layer which are of predetermined size and shape, the construction and arrangement being such that the light splitting or modifying effects caused by said particulate material in said first layer and visible in ambient light is suppressed by the passage of light from a source located at the reverse side of the panel so that the presence of said at least selected areas become visible from the obverse side of the panel.

Such technology is available from the Applicant under the trade name "Decorative Secret-Til-Lit" (DSTL™).

Advantageously, a suitable first layer may comprise an at least substantially transparent carrier containing particulate semi-transparent colour producing material. A suitable material may be a flaked, iridescent material of the kind exemplified by mica. Mica flakes may be pre-coated with ultra-thin layers of pigment, for example, oxides of metals such as titanium or iron. Other pigments may be used, e.g. pearl/lustre pigments, geometric pigments, diftractive pigments or light interference pigments.

Advantageously, the visual effect of the presence of pigment may be varied according to the thickness of the pre-coating. Variations may also be observed in accordance with the base colour of the substrate layer and the degree of translucency thereof.

Advantageously, said second layer may be provided as graphics in the form of information symbols applied in a discontinuous layer of an opaque or substantially opaque pigment . Conveniently said pigmented material may be printed pigmented ink or the like.

Alternatively said second layer may be colour tinted in a contrasting hue so that the colour tint is visible only on the passage of light from a source located at a reverse side of the panel.

At least a portion of the panel may comprise or include a metallic finish which may be provided by means of a metallised film.

The panel may be of a spattered or laminated construction.

In examples of panels according to the invention and their use, the panels may be comprised of a partially-transparent panel substrate which is of the kind referred to as smoke-coloured. The colour may, if preferred, be imparted to the panel in a third layer which may be applied by a printing technique, such as screen printing, but if preferred, may be obtained by the inclusion of pigment in the plasties material or other material of the panel substrate. It may be found that high quality visual effects are obtained with the use of pigments of a relatively dark hue.

The first layer may be provided by coating the substrate with a layer including—ultra-thin flakes of mica that in the present examples have been pre-coated with titanium dioxide. The coated flakes are capable of splitting light into its visible component colours, the apparent colour depending upon the thickness of the titanium dioxide layer or other pigment on the mica. This varies in the present examples from 40 to 160 nm giving a range of colour from silver-white through copper-red, lilac, vivid blue, turquoise and finally green, the colour sequence being repeated if additional thickness is imparted to the titanium dioxide layer.

It should be noted that in addition to the effect described above, colour changes may be seen according to the angle from which the coated mica flakes are observed, the so-called interference colour being visible only at the glancing angle. Colours seen at the other angles will differ. For example, if a blue "interference" layer of pigmented material forms a coating on a white background, then the light reflected at the glancing angle is blue and masks the complementary colour, yellow, which is seen at other angles. On a coloured background, the transparency of the coating permits the background colour to be visible through the coating, but at the glancing angle the interference colour predominates . On a curved panel both colour effects may be observed at the same time on differing areas of the panel to give a pleasing or aesthetic effect.

In a panel in accordance with the invention, the positioning of a light source behind the panel will allow light from that source to penetrate the panel and the pigmented coating of the first layer. Because the light from behind the panel is of a greater intensity than ambient light falling on the obverse surface of the panel, the colour effect visible in the first layer will be suppressed and the colours of the second layer will predominate as the panel "lights up". The provision of graphics if present in the second layer will permit symbols or the like to be visible as dark or darker areas against the back-lit panel.

The invention still further provides a switch panel assembly adapted to provide a variable visual appearance to a decorative/switch panel constructed in accordance with the first aspect of the present invention, said assembly optionally further comprising a support device mounting said panel, and a source of light (illumination means) positioned behind the reverse surface of the panel and adapted to provide light arranged to pass through the panel, e.g. substrate and said layers, wherever the opacity thereof permits.

According to a second aspect of the present invention there is provided a panel, e.g. a formed, shaped or moulded member or body, for use in the switch panel according to the aforementioned general solution or the switch panel or control panel according to the first aspect of the present invention.

Such forming may take place after coating with the material for reducing the effects of ultraviolet light, and/or after decorating the panel or film.

Suitable forming techniques include high pressure forming, which is preferred, or vacuum forming, match metal forming or the like.

Following forming, the shaped panel or film may be subjected to further processing steps, e.g. cutting, injection moulding, and/or insert moulding.

The moulding process, e.g. injection moulding, may be performed as either so-called single or multi-shot, e.g. two shot.

The material to be injected may comprise any suitable material, but typically this is chosen from polycarbonate, acrylonitrite-butadiene-styrene copolymer (ABS) or mixtures thereof.

According to a third aspect of the present invention there is provided an apparatus having a switch panel according to the aforementioned general solution or a switch panel or control panel according to the first aspect of the present invention.

In a beneficial implementation, the apparatus may be an automotive vehicle such as an automobile, lorry, van, off-road vehicle, motorcycle or the like.

In an alternative implementation the apparatus may be an electronic/electrical apparatus such as white goods, consumer electronic goods, industrial electronic apparatus, keyless entry system, or keypad.

In a further alternative implementation the apparatus may be a window or a door, e.g. a shop window, glass window, or a glass door.

Means may be provided for reducing effects upon at least part of the panel caused by exposure to ultraviolet radiation.

The panel may comprise a substrate layer, at least one ink layer, and an ultraviolet reducing layer.

The substrate layer may comprise a polycarbonate material and the at least one ink layer may comprise a polycarbonate based ink.

The ultraviolet reducing means may comprise polyvinyldifluoride or a material based thereon.

Effects caused by ultraviolet radiation can be fading or bleaching of colour, embrittlement of the panel, particularly if comprised of plastic material, cracking and the like. These effects are considered to be deleterious or unwanted and reduction thereof may be desirable.

The means for reducing the effects of ultraviolet light exposure can be provided in the form of a coating. This coating may be applied to at least a portion of the panel.

Preferably the coating is applied to at least part of an outermost surface of the panel, which preferably is a surface of the obverse side. The coating may therefore also act as a scratch resistant coating.

A coating substance found to be particularly beneficial comprises polyvinyldif luoride or a material based thereon.

Typically the coating has a thickness of at least 25 μm.

The panel may be made from a polymer material such as a transparent/translucent polymer. Preferably polycarbonate is used, but other useful polymers include acrylic polyester or other similar thermoplastic materials.

BRIEF DESCRIPTION OF DRAWINGS

Embodiments of the invention will now be described by way of example only, and with reference to the accompanying drawings, which are:

FIG. 19(*b*) a schematic side view of a modification to the infrared switch panel of FIG. 18 including tactile feedback;

DETAILED DESCRIPTION OF DRAWINGS

Figure 1:
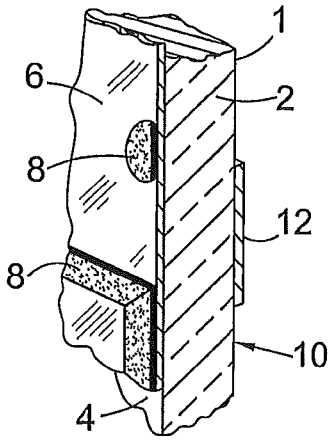
Fig. 1 (Prior Art)
FIG. 1 a fragmentary perspective view of a portion of a panel for use in a switch panel according to the present invention.

Referring initially to FIG. 1, there is illustrated a panel 1 comprising part of a switch panel, such as an automotive vehicle component, according to an embodiment of the present invention, which will be described hereinafter. The panel 1 comprises a substrate layer 2 which is of plastics material, in the present example a transparent polycarbonate sheet. It will be understood that the substrate may be of any transparent material, e.g. glass or plastics, may be flexible or rigid, and may be contoured, e.g. by a forming technique, or flat, as desired.

Applied to an obverse surface 4 of the substrate layer 2 is a layer 6 of smoky or similarly tinted material which introduces a degree of opacity to the substrate to the extent that when viewed in ambient light or daylight falling on said obverse surface 4, the panel 1 gives a dense appearance.

The layer 6 is then provided with a layer 8 comprising a transparent coating of acrylic varnish or other suitable carrier in which is entrained a quantity of flaked mica particles which have been pre-coated with a titanium oxide pigment (or other metal, e.g. aluminium), to give a desired colour-effect by means of the light-modifying properties of mica (iridescence). In the present example, the layer 8 is discontinuous, but if preferred, it may comprise a continuous coating.

Layer 8 is then optionally provided with a coating 9 (shown in FIGS. 2 to 6) of a material to reduce the effects of exposure to ultraviolet radiation. The coating 9 is in this embodiment made substantially of polyvinyldif luoride (PVDF) to a thickness of around 25 μm.

On a reverse surface 10 of the substrate 2 is provided a discontinuous applied layer 12 of an opaque or substantially opaque pigmented ink, or the like, in a predetermined pattern—in the present example letters or graphics. In the present example, the pattern is applied by a screen printing technique, but any suitable technique may be used, e.g. an off-set lithographic process.

Figure 2:
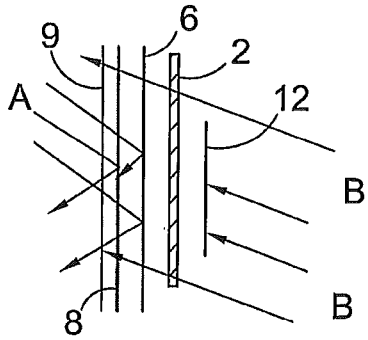
Fig. 2 (Prior Art)
FIG. 2 an illustration of layers of the panel of FIG. 1 and a direction of light falling thereon.

The effect of light on the panel 1 of FIG. 1 is shown diagrammatically in FIG. 2.

Ambient light or daylight is shown by arrows A falling on the obverse side of the panel 1 (the left hand side in the Figures). The light reflects from the particles in the layer 8 and tends to be absorbed by layer 6 (smoked), so that the eye is aware only of the colour effect of the layer 8, which is at least partially iridescent.

However, a source of illumination is provided to selectably produce light rays (arrows B) from the rear of the panel 1 to fall on the reverse side thereof as required. These rays (B) pass through the substrate 2 and the layers 6 and 8 and are of sufficient intensity that the colour effects of these layers are suppressed and indeed it is no longer possible to see the pattern or decoration afforded by the pigmented layer 8. However, some of the rays do not penetrate the layer 12, and therefore, the pattern of the pigmented ink comprising the layer 12 becomes visible to the eye through the other layers.

It will be understood that in an alternative arrangement, the layer 12 may comprise one or more contrasting colour hue(s) which predominate over the layer 8 when back illumination is present (rays B).

It will be understood that advantageously the layers may be in direct and intimate contact with each other, and/or the substrate, e.g. laminated together. Alternatively, it may, if convenient, be preferred to provide a gap between any adjacent pair of layers.

FIGS. 3 to 6 show variations in the arrangements of the layers which are possible within the scope of the invention. It will be appreciated that, if desired or required, a coating of a material to reduce the effects of exposure to ultraviolet radiation can be provided, e.g. on the outermost obverse surface in each arrangement.

Figure 3:
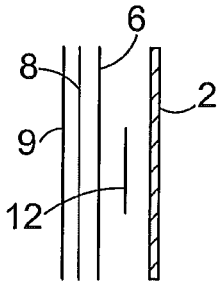
Fig. 3 (Prior Art)
FIGS. 3 to 6 illustrations of four alternative arrangements of layers of panels for use in switch panels according to the present invention.

FIG. 3 shows an arrangement in which the layers run from left to right as follows:

(a) layer 8
(b) layer" 6
(c) layer 12
(d) substrate.

Figure 4:
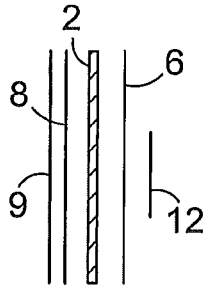
Fig. 4 (Prior Art)

FIG. 4 has the arrangement:

(a) layer 8
(b) substrate
(c) layer 6
(d) layer 12.

Figure 5:
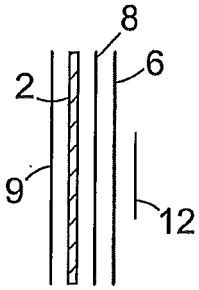
Fig. 5 (Prior Art)

FIG. 5 has the arrangement:

(a) substrate
(b) layer 8
(c) layer 6
(d) layer 12.

Figure 6:
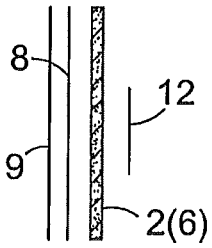
Fig. 6 (Prior Art)

In FIG. 6, however, the layer 6 (smoked) is replaced by the provision of a smoky dye effect in the plastics material of the substrate itself. Therefore the arrangement is:

(a) layer 8
(b) substrate (with smoky effect)
(c) layer 12.

Figure 7A:
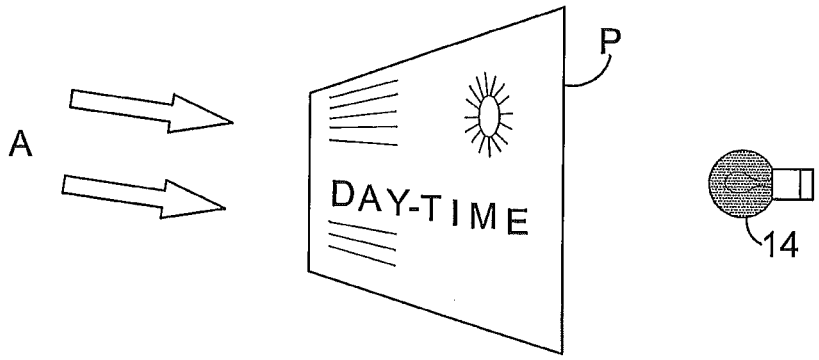
Fig. 7(a) (Prior Art)
FIGS. 7(*a*), 7(*b*) and 8 illustrations of visible effects obtainable with use of the panel of FIG. 1, 2, or 3 to 6.
Figure 7B:
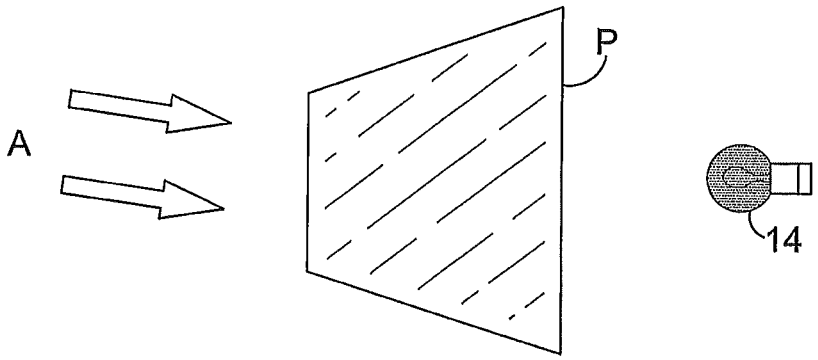
Fig. 7(b) (Prior Art)

The visual effect of the use of the panel 2 is illustrated in FIGS. 7(*a*), 7(*b*) and 8.

Referring to FIG. 7(*a*), a panel P having layers 6, 8 and 12 arranged on a substrate as in, for example FIG. 2, is viewed in natural daylight (arrows A). The presence of the discontinuous layer 8 is viewed by the eye as, in this example, representation of the sun and the words DAY-TIME.

Figure 8:
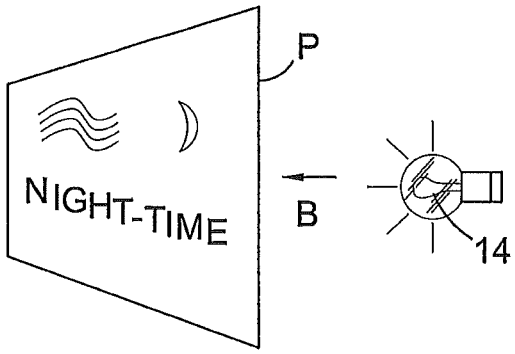
Fig. 8 (Prior Art)

However, if an illumination means 14 (e.g. LED or bulb) is switched on and the back light level predominates, the appearance changes to that shown in FIG. 8, in which the sun and the wording has disappeared and instead the back lighting has rendered visible the pattern of the layer 12, which in this example, depicts a crescent moon and the word NIGHT-TIME.

It will be noticed that in FIGS. 7(*a*) and 8 the letters T, I, M, E, are common to the wording in both lighting conditions. This is achieved in the present example by the provision of layer 8 in two sub-layers, one which covers the general area except for gaps in the shapes corresponding to the letters and another which reads "-TIME" applied on top of the first sub-layer at the appropriate position. When the light bulb 14 is illuminated, light shines through gaps provided in layer 12 in the shape of the letters "NIGHT-" and these are rendered visible, whereas the visibility of the, letters "DAY-" has been diminished to the point where the eye cannot detect them.

FIG. 7(*b*) shows an alternative visual effect to the panel of FIG. 7(*a*) in that when viewed in daylight, i.e. not back-lit, the panel P is seen to be of a plain colour or design, with no message-shown, thereby offering a blank surface.

In examples of panels for use in the present invention, it will be understood that a variety of materials may be chosen for the substrate and for the layers. Moreover, the thicknesses of the various layers may be selected as required for the purpose concerned.

For example, the thickness of the substrate layer 2 may typically be from, say 0.075 mm up to 10 mm or if appropriate up to 15 mm or 20 mm. In providing the layer, the pigmented carrier may be an acrylic varnish or a blending base, and may for instance be water-based if preferred. The size and shape of the particles is determined by that of the mica flakes from 5 μm to 60 μm (microns) being suitable, although flakes up to 180 μm in size may be used and may be present in the carrier varnish in the proportions 1% to 10%, typically 3-5%. The thickness of the layer 8 may be between 3 μm and 30 μm, although a range of from 6 μm to 15 μm may be preferred, typically 6 μm to 7 μm.

The decorative feature of the layers 8 and 12 may be purely informative, i.e. instructions or data, and may be in the form of a layer which is continuous except for shaped gaps, or comprised by "islands" of pigmented carrier.

Figure 9:
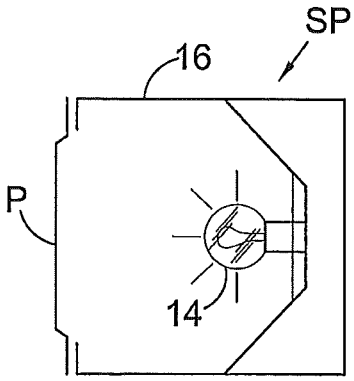
Fig. 9 (Prior Art)
FIG. 9 a diagrammatic cross-sectional view through a switch panel including a panel according to the invention.

FIG. 9 of the drawings illustrates a switch panel SP according to an embodiment of the invention, and including a panel P as described in any of the examples given above, which has been formed so as to be contoured, i.e. not flat as in the original sheet material, and has been mounted in a support device 16, which also supports an illumination means, for example, an LED or bulb 14. It will be understood that FIG. 9 is purely diagrammatic and can represent any suitable mounting and support means such as may, for example, be appropriate for inclusion in a vehicle centre-stack, vehicle dashboard or fascia display, or alternatively in an information panel for varying data between alternative display modes, variable-appearance decorative panels for commercial, retail or similar premises, point-of -sale displays as well as for domestic and industrial appliances, instrument panels, and the like.

Figure 10:
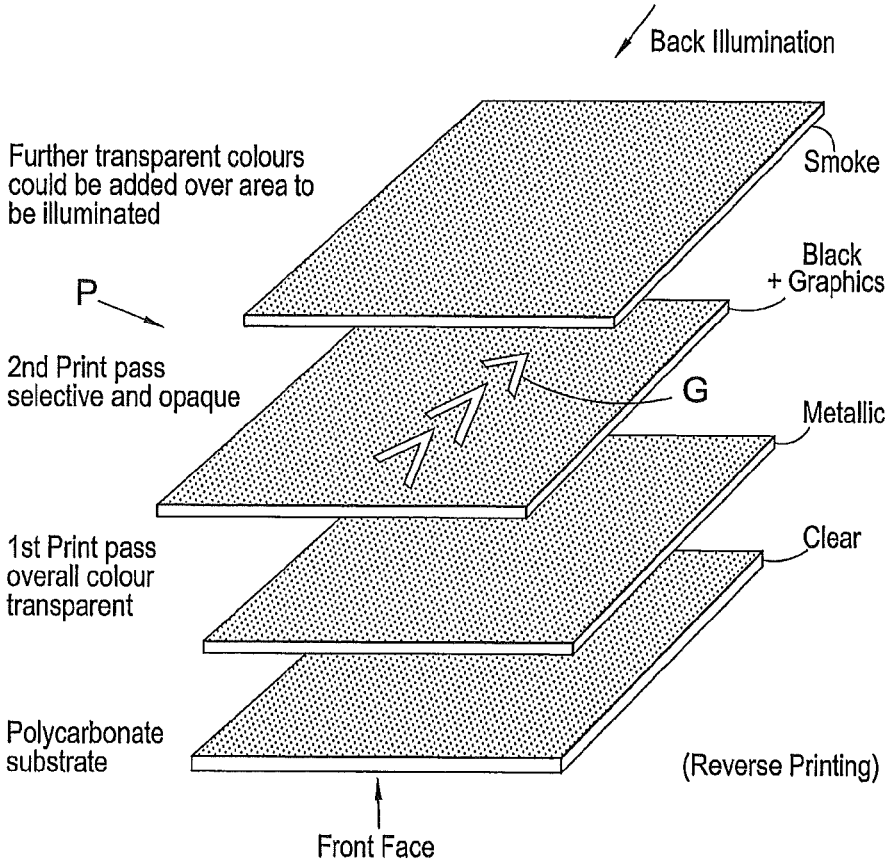
Fig. 10 (Prior Art)
FIG. 10 a layer construction of a decorative panel for use in a switch panel according to the invention.
Figure 11:
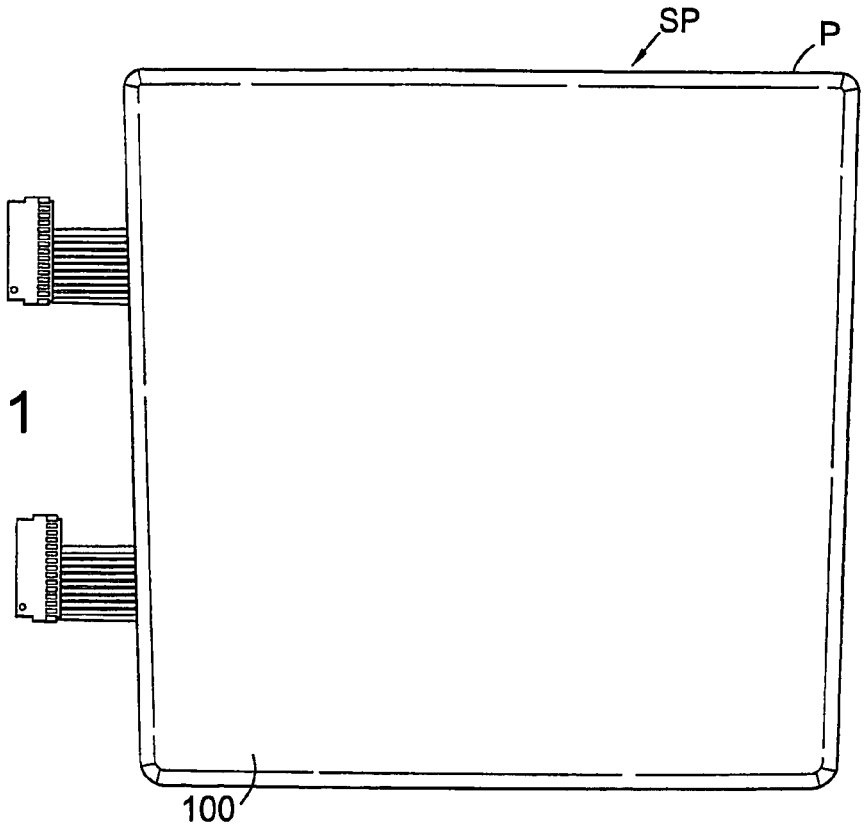
FIG. 11 a front view of a capacitive switch panel according to an embodiment of the present invention adapted for use as a centre stack of an automotive vehicle in a front-lit configuration.
Figure 12:
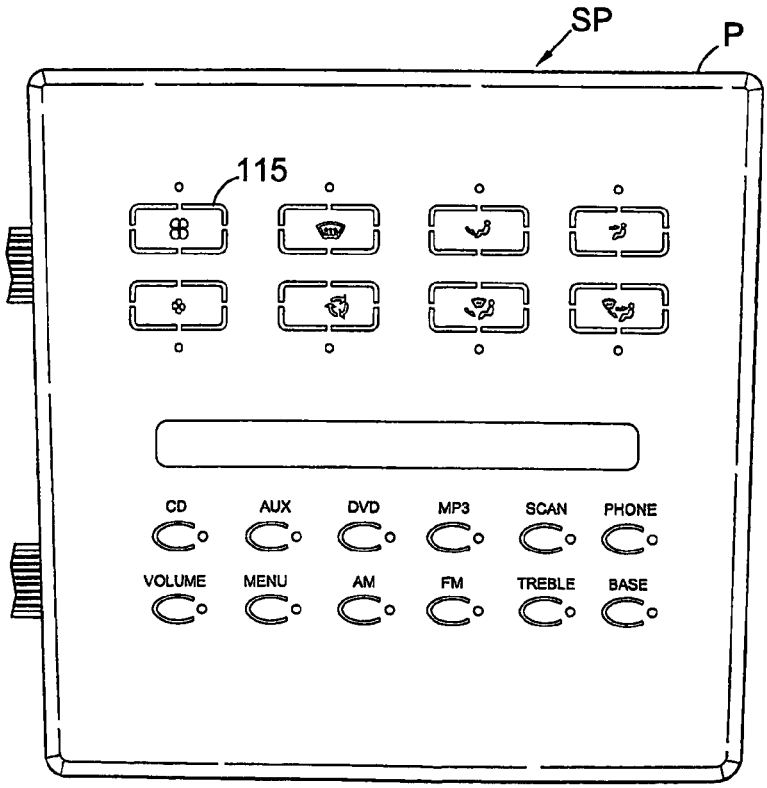
FIG. 12 a front view of the switch panel of FIG. 11 in a back-lit configuration.
Figure 13:
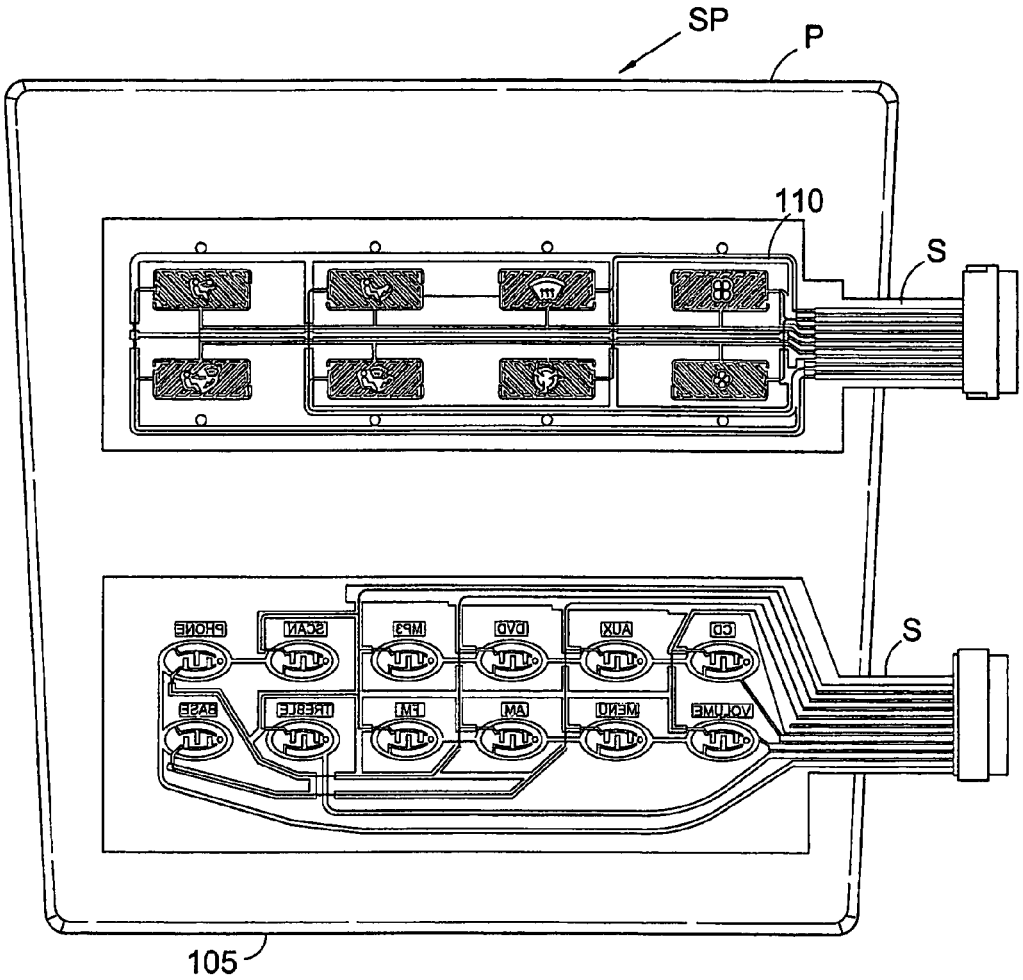
FIG. 13 a rear view of the switch panel of FIG. 11.
Figure 14:
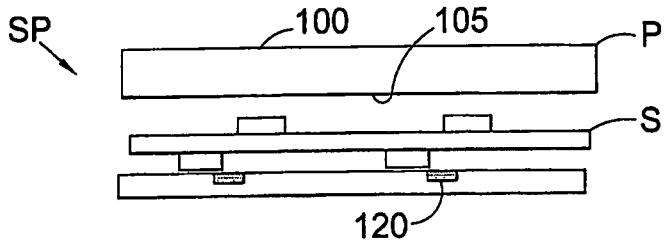
FIG. 14 a schematic side view of the capacitive switch panel of FIG. 11.

FIG. 10 illustrates an alternative embodiment and shows the layer constructions of a panel P with print layers applied to a polycarbonate substrate. The graphics G are only seen when the panel P is illuminated from the reverse side.

Referring now to FIGS. 11 to 14 there is shown provided a switch panel or control panel, generally designated SP, according to an embodiment of the present invention. The switch panel SP comprises a panel P and switch means s, the panel P having an obverse side 100 and a reverse side 105, wherein, in use, when viewed from the obverse side 100 the panel P has a first appearance when not illuminated from the reverse side 105, and at least one second appearance when illuminated from the reverse side 105.

The switch means S comprises a plurality of switches 110. The switch means S comprises a transparent conductor such as indium tin oxide (ITO).

The panel P comprises a plurality of markings or indicia 115, each marking 115 being associated with one of the plurality of switches 110.

The switch panel SP comprises a plurality of illumination means 120, each illumination means 120 being associated with one of the plurality of switches 110. Each illumination means 120 comprises an LED and optional diffusion means.

When a particular switch 110 is off, the associated illumination means 120 is off. Thus the associated marking 115 is not back illuminated, and for example, when front lit, e.g. in daylight, the associated marking 115 is not visible or alternatively only partially visible, e.g. in outline.

When a particular switch 110 is on, the associated illumination means 120 is on. Thus the associated marking 115 is back illuminated, and for example either in daylight or at night the associated marking 115 is visible.

The switches 110 are mounted on a rear side of the panel P, substantially coplanarly one with the other and substantially parallel to the panel P. The illumination means 120 are each mounted on a rear side of the switches 110.

The panel P comprises a substantially rigid sheet of plastics material, e.g. polycarbonate, acrylic or polyester. The sheet may have a plurality of ink layers printed thereon—as hereinbefore described—so as to provide the required visual effects, e.g. preferably on the rear surface thereof, or alternatively, on the obverse surface thereof. The sheet may be around 1 mm to 2 mm in thickness.

Alternatively in a modification the panel comprises an applique or foil of plastic material, e.g. polycarbonate or polyester. The foil may have a plurality of ink layers printed thereon so as to provide the required visual effects. The foil may be around 50 mm to 250 mm in thickness. The foil may be moulded, e.g. in-moulded, to a rigid (transparent) bonding sheet of polycarbonate or polyester.

Each switch 110 can be switched on or off by a user by placing a finger on or adjacent the associated marking 115 thereby switching the associated illumination means 120 on or off. In this way various functions of the switch panel SP can be controlled.

The switch panel SP is particularly beneficial for use in an automotive vehicle, e.g. as a panel for a so-called centre stack between driver and front passenger, or alternatively as at least part of a door panel or roof panel or other panel for use within an automotive vehicle.

In such use the switch panel SP can provide markings/switches for one or more of: ventilation controls, air conditioning, climate control, electronic/entertainment equipment, e.g. audio equipment, television, radio, CD, DVD, MP3, telephone, navigational equipment, and associated switches which associated switches, e.g. volume etc, are illuminated only when the respective equipment control is selected.

The switch panel SP can alternatively be adapted for use in electronic goods, e.g. white goods, consumer electronic goods, keypads, keyless entry pads, or other industrial equipment or the like.

The switch panel SP can alternatively be adapted for use in other modes of transportation, e.g. motorcycles, trains, planes or boats.

Figure 18:
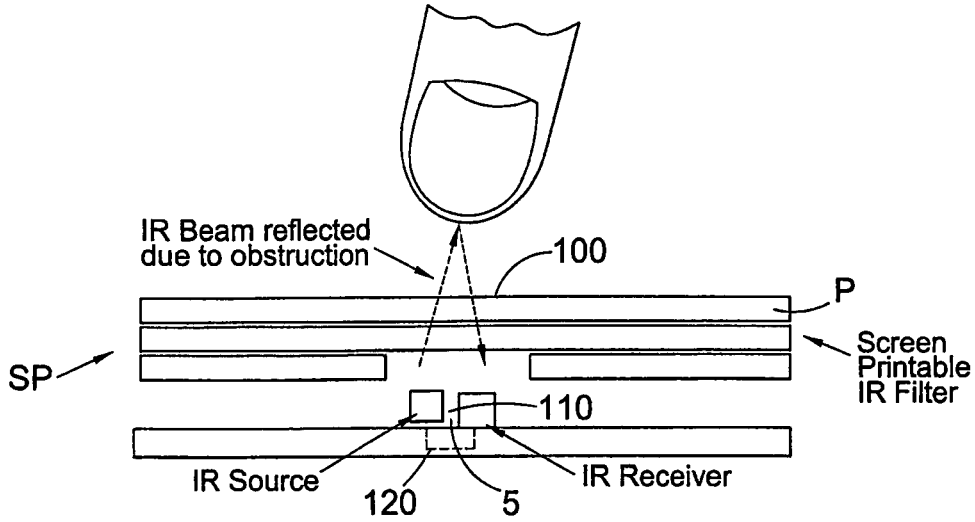
FIG. 18 a schematic side view of an infrared switch panel according to an embodiment of the present invention.
Figure 19A:
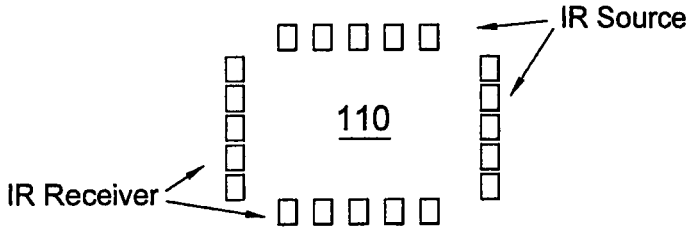
FIG. 19(*a*) a schematic view of a switch matrix comprising switches of the switch panel of FIG. 18.
Figure 19B:
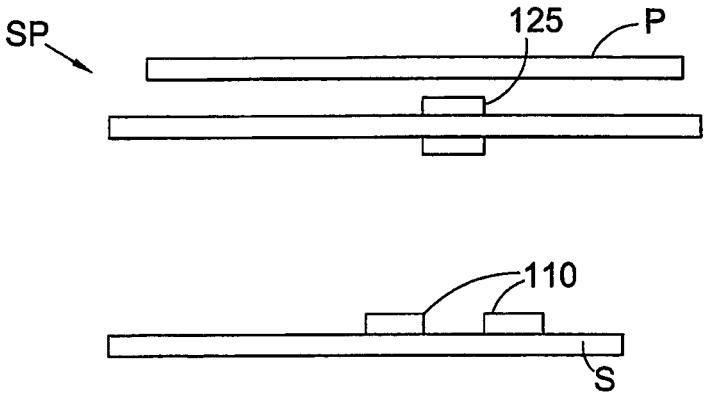

In the switch panel SP of FIGS. 11 to 14, the switches 110 are selected from a type comprising capacitive elements. Alternatively and advantageously the switch or switches may be selected from a type comprising infrared (FIGS. 18 and 19). Alternatively the switch or switches may be selected from a type comprising piezoelectric, or alternatively, mechanical FIGS. 20(*a*) to (*c*).

In a switch panel SP having piezoelectric switches (not shown) it is envisaged that the layout and configuration can be substantially as for the capacitive switch panel SP of FIGS. 11 to 14, suitably adapted.

Figure 20A:
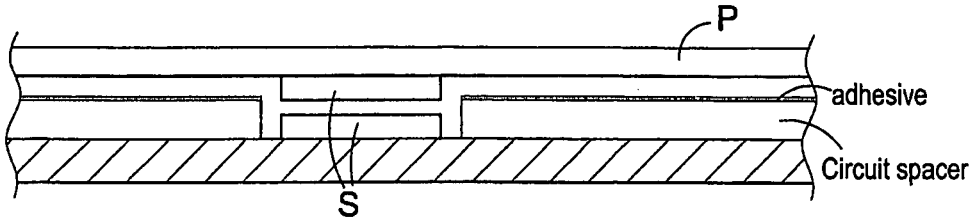
FIGS. 20(*a*) to (*c*) schematic side views of a mechanical switch panel according to an embodiment of the present invention.
Figure 20B:
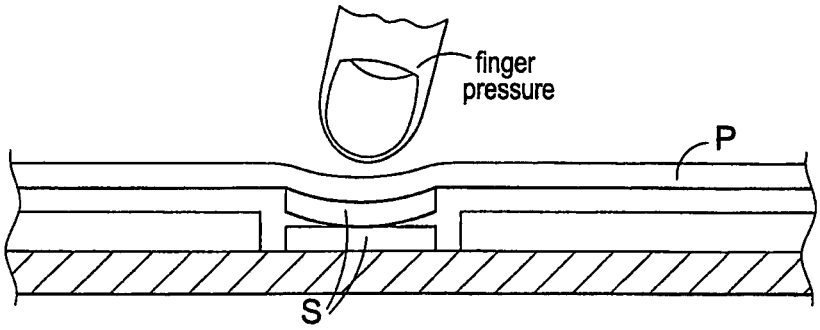
Figure 20C:
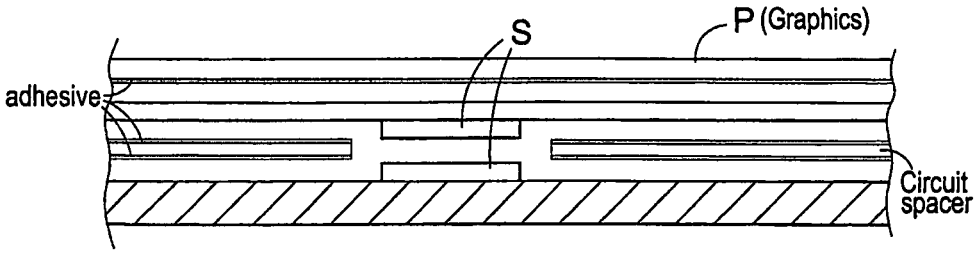
Figure 21:
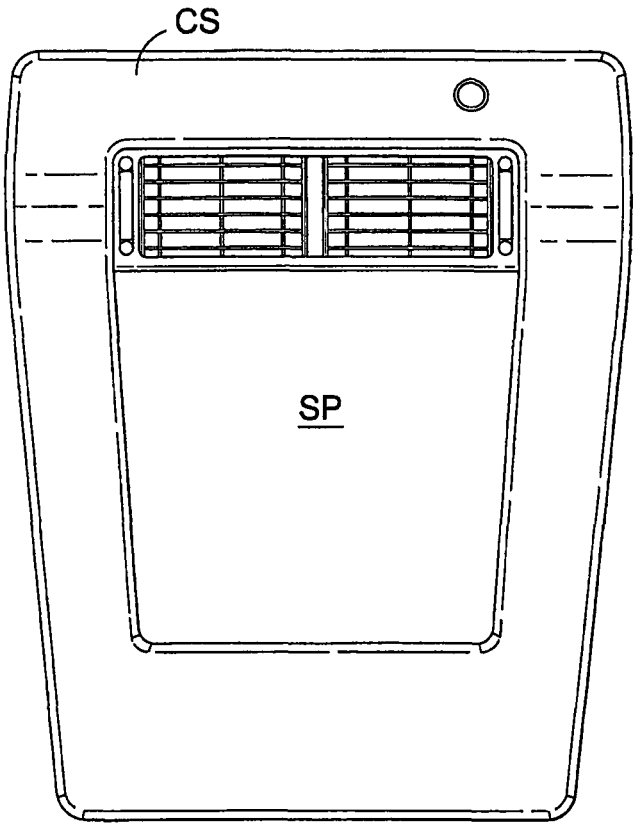
FIG. 21 a front view of a centre stack of an automotive view comprising a switch panel according to any of the embodiments of the present invention disclosed herein.

Referring to FIGS. 20(*a*), (*b*) and (*c*), FIG. 20(*a*) shown foil/membrane panel P and switches s. In use, as shown in FIG. 20(*b*), panel P flexes so as to close switch s. When pressure is released the panel P returns to the original position (FIG. 20(*a*)) and switch S opens. FIG. 20(*c*) shows in more detail the layers of the mechanical switch panel.

Figure 15:
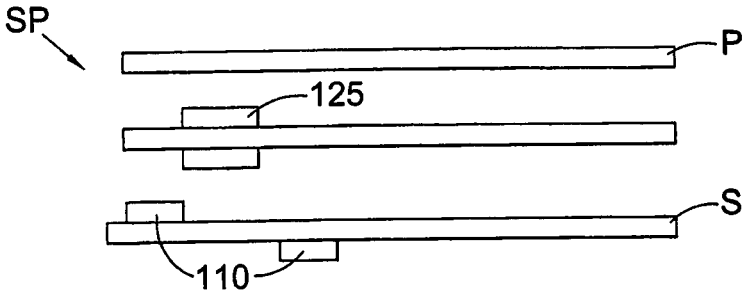
FIG. 15 a schematic side view of a modification to the capacitive switch panel of FIG. 11, including tactile feedback.
Figure 16:
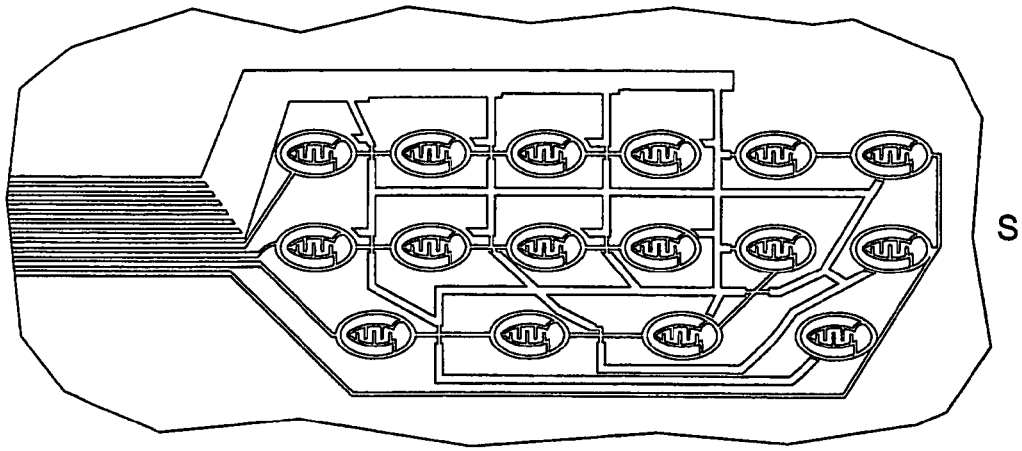
FIG. 16 an array of switches for use in a further modified capacitive switch panel.
Figure 17:
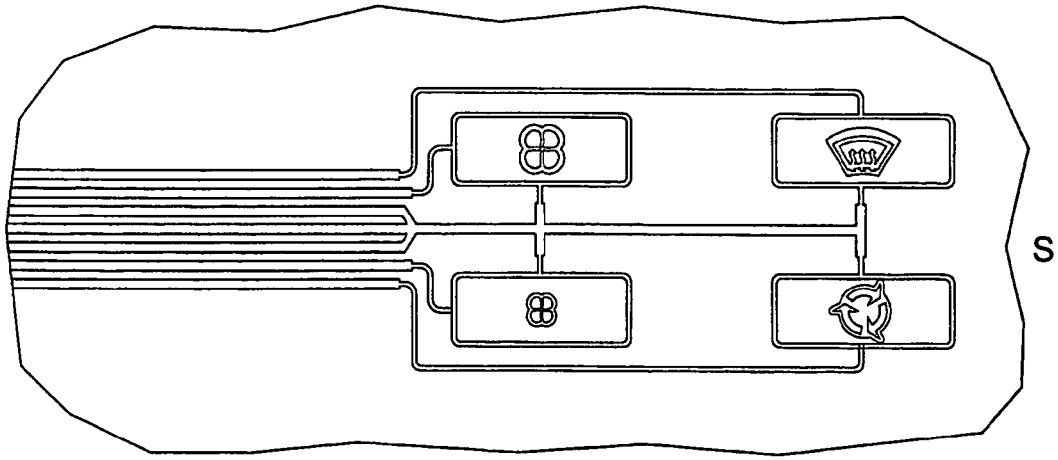
FIG. 17 an array of switches for use in a yet further modified capacitive switch panel.

In the case of capacitive, infrared or piezoelectric, the/each switch 110 can be provided with tactile feedback means (see FIG. 15). That is to say a user when placing a finger over a selected switch can feel a localised vibration or oscillation so as to feel that the selected switch has been turned on or off. Such tactile feedback is provided by, e.g. a piezoelectric transducer 125, each switch 110 being provided with an associated piezoelectric transducer 125.

It will be appreciated that the embodiments of the present invention hereinbefore described are given by way of example only, and are not meant to limit the scope thereof in any way. It will particularly be appreciated that the disclosed embodiments may be modified to include any of the features disclosed herein.

It will be appreciated herein that a portion of the panel is "backlit" if the intensity of light from the rear is greater than the intensity of light from the front. Similarly, a portion of the panel is "front lit" if the intensity of light from the rear is less than the intensity of light from the front. Light from the rear may be provided by the illumination means. Light from the front may be provided by daylight or ambient lighting.

The invention claimed is:

1. A switch panel comprising:

at least one switch;

a panel member including a substantially rigid sheet, a first layer comprising a coating with an at least substantially transparent carrier containing non-opaque particulate materials, and a second layer provided rearwardly of the first layer and comprising an ink layer providing at least one marking or indicia on a respective portion of the panel member, the or each marking or indicia being associated with the or one of the at least one switch, wherein the switch panel has an obverse side and a reverse side and wherein, in use, when viewed from an obverse side the panel member has a first appearance when not illuminated from a reverse side, and at least one second appearance when at least a portion thereof is back lit or illuminated from the reverse side, such that in the first appearance at least one of the at least one marking or indicia is either not visible or only partially visible and in the second appearance at least one of the at least one marking or indicia is visibly illuminated, wherein the or one of the at least one switch is switched on or off by a user by placing a finger on or adjacent an associated marking or indicia thereby selectably illuminating the associated marking or indicia.

2. A switch panel as claimed in claim 1, wherein the or each at least one switch is an electrical or electronic switch.

3. A switch panel as claimed in claim 1, wherein the switch at least partly comprises an at least partially transparent conductor selected from indium tin oxide (ITO), or a non-transparent conductor selected from silver or copper.

4. A switch panel as claimed in claim 1, wherein the rigid sheet comprises a plastics material selected from the group consisting of polycarbonate, acrylic and polyester.

5. A switch panel as claimed in claim 1, wherein the rigid sheet comprises glass.

6. A switch panel as claimed in claim 1, wherein the sheet has a plurality of ink layers printed thereon.

7. A switch panel as claimed in claim 1, wherein the switch panel provides one or more switch portions which are concave or convex to provide at least one of a visual and tactile indication of a position of a switch.

8. A switch panel as claimed in claim 1, wherein one or more switch portions are provided with a soft touch coating on an obverse surface of the switch panel, to provide a tactile indication of a position of a switch.

9. A switch panel as claimed in claim 1, wherein the switch panel is adapted for use in or forms a part of a glass door or a window.

10. A switch panel as claimed in claim 1, wherein the switch panel is adapted for use in other modes of transportation selected from at least one of the group consisting of motorcycles, trains, planes, ships, yachts and boats.

11. A switch panel as claimed in claim 1, wherein at least a portion of the panel comprises or includes a metallic finish which is provided by means of a metallised film.

12. A switch panel assembly comprising:

a switch panel according to claim 1, a support device for mounting said switch panel, and a source of light or illumination means positioned behind a reverse surface of the switch panel and adapted to provide light arranged to pass through the switch panel, wherever the opacity thereof permits.

13. A switch panel as claimed in claim 1, wherein the first layer comprises an at least substantially transparent carrier containing particulate semi-transparent colour producing material.

14. A switch panel as claimed in claim 1, wherein the first layer has a thickness of about 3 μm to about 30 μm.

15. A switch panel as claimed in claim 1, wherein the back lighting is provided by illumination means controlled by the at least one switch.

16. A switch panel as claimed in claim 15, wherein the at least one switch is provided on a reverse or rear side of the panel member and is controlled by a user from an obverse or front side of the panel member.

17. A switch panel as claimed in claim 1, wherein the sheet is around 0.5 mm to 10 mm in thickness.

18. A switch panel as claimed in claim 17, wherein the sheet is around 1 mm to 2 mm in thickness.

19. A switch panel as claimed in claim 1, wherein the panel is adapted for use as a part of an automotive vehicle centre stack panel, or as at least part of a door panel or roof panel or other automotive vehicle panel.

20. A switch panel as claimed in claim 19, wherein the switch panel provides markings for switches selected from at least one of the group consisting of: ventilation controls, air conditioning, climate control, heating, television, radio, audio equipment, CD, DVD, MP3, telephone, navigational equipment, such that associated switches are illuminated only when the respective equipment control is selected.

21. A switch panel as claimed in claim 1, wherein the switch panel is adapted for use in electronic equipment or goods.

22. A switch panel as claimed in claim 21, wherein the switch panel is adapted for use in electronic equipment or goods selected from at least one of the group consisting of white goods, consumer electronic goods, industrial equipment, and keyless entry equipment.

23. A switch panel as claimed in claim 1, wherein the panel comprises a partially transparent panel substrate.

24. A switch panel as claimed in claim 23, wherein the partially transparent panel substrate is smoke coloured.

25. A switch panel as claimed in claim 1, wherein the switch panel comprises at least one illumination means, the or each illumination means being associated with the or one of the at least one switch.

26. A switch panel as claimed in claim 25, wherein each illumination means comprises an LED.

27. A switch panel as claimed in claim 25, wherein when a particular switch is off, the associated illumination means is off.

28. A switch panel as claimed in claim 25, wherein when a particular switch is on the associated illumination means is on.

29. A switch panel as claimed in claim 25, wherein the switch is mounted on a rear side of the panel member, substantially coplanarly one with the other and substantially parallel to the panel member.

30. A switch panel as claimed in claim 25, wherein the at least one illumination means is mounted on a reverse side of the at least one switch.

31. A switch panel as claimed in claim 1, wherein the at least one switch is selected from a type consisting of capacitive, infrared, and piezoelectric.

32. A switch panel as claimed in claim 31, wherein the at least one switch is provided with tactile feedback means.

33. A switch panel as claimed in claim 32, wherein the tactile feedback is provided by a piezoelectric transducer.

34. A switch panel as claimed in claim 1, wherein the material is a flaked, iridescent material.

35. A switch panel as claimed in claim 34, wherein the material is mica.

36. A switch panel as claimed in claim 34, wherein the material is pre-coated with a pigment.

37. A switch panel as claimed in claim 36, wherein the material pigment is a metal oxide.

38. An apparatus having a switch panel according to claim 1.

39. An apparatus as claimed in claim 38, wherein the apparatus is an automotive vehicle.

40. An apparatus as claimed in claim 39, wherein the automotive vehicle is selected from at least one of the group consisting of an automobile, lorry, van, off-road vehicle, or motorcycle.

41. An apparatus as claimed in claim 38, wherein the apparatus is an electronic/electrical apparatus.

42. An apparatus as claimed in claim 41, wherein the electronic/electrical apparatus is selected from at least one of the group consisting of white goods, consumer electronic goods or industrial electronic apparatus or a keyless entry system, or a keypad.

43. An apparatus as claimed in claim 38, wherein the apparatus is a window or a door.

44. An apparatus as claimed in claim 43, wherein the window or door is selected from at least one of the group consisting of a shop window, glass window, or a glass door.

45. An apparatus as claimed in claim 38, wherein means are provided for reducing effects upon at least part of the panel caused by exposure to ultraviolet radiation.

46. An apparatus as claimed in claim 45, wherein the panel comprises a substrate layer, at least one ink layer, and an ultraviolet reducing layer.

47. An apparatus as claimed in claim 46, wherein the substrate layer comprises a polycarbonate material and the at least one ink layer comprises a polycarbonate based ink.

48. An apparatus as claimed in claim 45, wherein the ultraviolet reducing means comprises polyvinyldifluoride or a material based thereon.

49. A switch panel as claimed in claim 1, wherein the panel is a decorative panel, wherein said first layer is an at least partially transparent layer, wherein at least selected areas of said second layer have a degree of contrast in at least one of opacity and colour, said first and second layers being associated with said substrate layer, wherein means are provided for furnishing said substrate layer with a partially transparent tinted appearance, wherein said non-opaque materials comprise non-opaque particulate light-splitting or light-frequency modifying materials, said materials being capable of causing light-splitting effects when viewed in light falling in the direction of the obverse surface of said substrate layer, and wherein said second layer provides said at least selected areas rearwardly of said first layer which are of predetermined size and shape, the construction and arrangement being such that the light splitting or modifying effects caused by said particulate material in said first layer and visible in ambient light is suppressed by the passage of light from a source located at the reverse side of the panel so that the presence of said at least selected areas become visible from the obverse side of the panel.

50. A switch panel as claimed in claim 49, wherein said second layer is provided as graphics in the form of information symbols applied in a discontinuous layer of an opaque or substantially opaque pigment, or said second layer is colour tinted in a contrasting hue so that the colour tint is visible only on the passage of light from a source located at a reverse side of the panel.

51. A switch panel as claimed in claim 49, wherein the first layer is provided by coating the substrate with a layer including ultra-thin flakes of mica that have been pre-coated with titanium dioxide, the coated flakes being capable of splitting light into its visible component colours, the apparent colour depending upon the thickness of the titanium dioxide layer or other pigment on the mica.

52. A switch panel as claimed in claim 49, wherein said non-opaque materials contain particulate semi-transparent colour producing material.

53. A switch panel as claimed in claim 52, wherein the material is a flaked, iridescent material.

54. A switch panel as claimed in claim 53, wherein the flaked, iridescent material is mica.

55. A switch panel comprising:

at least one switch selected from at least one type of the group consisting of capacitive, infrared, and piezoelectric;

a panel member including a substantially rigid sheet, and at least one marking or indicia provided by an ink layer on a respective portion of the panel member, the or each marking or indicia being associated with the or one of the at least one switch member, wherein the switch panel has an obverse side and a reverse side and wherein, in use, when viewed from an obverse side the panel member has a first appearance when not illuminated from a reverse side, and at least one second appearance when at least a portion thereof is back lit or illuminated from the reverse side, such that in the first appearance at least one of the at least one marking or indicia is either not visible or only partially visible and in the second appearance at least one of the at least one marking or indicia is visibly illuminated.

56. A switch panel or control panel as claimed in claim 55, wherein the at least one switch is provided with tactile feedback means.

57. A switch panel as claimed in claim 56, wherein tactile feedback is provided by a piezoelectric transducer.

* * * * *

UNITED STATES PATENT AND TRADEMARK OFFICE

CERTIFICATE OF CORRECTION

PATENT NO. : 8,506,101 B2
APPLICATION NO. : 11/666768
DATED : August 13, 2013
INVENTOR(S) : Mathers et al.

It is certified that error appears in the above-identified patent and that said Letters Patent is hereby corrected as shown below:

In the Specification:

Column 8, Line 15: Correct "(b) layer" 6"
to read -- (b) layer 6 --

Signed and Sealed this
Sixteenth Day of September, 2014

Michelle K. Lee

Michelle K. Lee
*Deputy Director of the United States Patent and Trademark Office*